US010233794B2

(12) United States Patent
Andersson et al.

(10) Patent No.: US 10,233,794 B2
(45) Date of Patent: Mar. 19, 2019

(54) VALVE ARRANGEMENT

(71) Applicant: VOLVO TRUCK CORPORATION, Göteborg (SE)

(72) Inventors: Arne Andersson, Mölnlycke (SE); Bincheng Jiang, Göteborg (SE); Staffan Lundgren, Hindàs (SE); Håkan Sandström, Lödöse (SE)

(73) Assignee: Volvo Truck Corporation, Göteborg (SE)

( * ) Notice: Subject to any disclaimer, the term of this patent is extended or adjusted under 35 U.S.C. 154(b) by 115 days.

(21) Appl. No.: 15/314,044

(22) PCT Filed: May 28, 2014

(86) PCT No.: PCT/EP2014/001426
§ 371 (c)(1),
(2) Date: Nov. 25, 2016

(87) PCT Pub. No.: WO2015/180742
PCT Pub. Date: Dec. 3, 2015

(65) Prior Publication Data
US 2017/0241304 A1 Aug. 24, 2017

(51) Int. Cl.
*F01L 3/20* (2006.01)
*F01L 1/46* (2006.01)
(Continued)

(52) U.S. Cl.
CPC ..... *F01L 3/205* (2013.01); *F01L 1/465* (2013.01); *F01L 3/20* (2013.01); *F01L 3/10* (2013.01);
(Continued)

(58) Field of Classification Search
CPC ... F01L 1/465; F01L 3/10; F01L 3/205; F01L 5/18; F01L 5/20; F01L 7/06; F01L 9/026;
(Continued)

(56) References Cited

U.S. PATENT DOCUMENTS 3,687,118 A * 8/1972 Nomura ..... F01L 3/205 123/73 A
4,356,798 A * 11/1982 Sakaoka ..... F01L 3/205 123/184.46
(Continued)

FOREIGN PATENT DOCUMENTS

EP 1 522 690 A2 4/2005

OTHER PUBLICATIONS

International Search Report (dated Feb. 17, 2015) for corresponding International App. PCT/EP2014/001426.
(Continued)

*Primary Examiner* — Jorge Leon, Jr.
(74) *Attorney, Agent, or Firm* — WRB-IP LLP

(57) ABSTRACT

A valve arrangement for a cylinder of an internal combustion engine arrangement includes a check valve configured to be positioned at an intake side port of the cylinder for controlling gas flow into the cylinder, wherein the valve arrangement further includes an intake valve arrangement positioned upstream from the check valve, and an actuating arrangement configured to controllably position the intake valve arrangement for closing the intake side port.

19 Claims, 5 Drawing Sheets

(51) Int. Cl.

| | |
|---|---|
| *F01L 5/18* | (2006.01) |
| *F01L 5/20* | (2006.01) |
| *F01L 7/06* | (2006.01) |
| *F01L 9/02* | (2006.01) |
| *F01L 9/04* | (2006.01) |
| *F01L 3/10* | (2006.01) |

(52) U.S. Cl.
CPC . *F01L 5/18* (2013.01); *F01L 5/20* (2013.01); *F01L 7/06* (2013.01); *F01L 9/026* (2013.01); *F01L 9/04* (2013.01); *F01L 2820/031* (2013.01); *F01L 2820/034* (2013.01)

(58) Field of Classification Search
CPC .. F01L 9/04; F01L 2820/031; F01L 2820/034
USPC ..... 123/90.14
See application file for complete search history.

(56) References Cited

U.S. PATENT DOCUMENTS

| | | | | |
|---|---|---|---|---|
| 4,368,698 | A * | 1/1983 | Matsuo | F01L 3/205 123/184.49 |
| 4,907,544 | A * | 3/1990 | Burrahm | F01L 1/02 123/26 |
| 5,495,830 | A * | 3/1996 | Wu | F01L 3/205 123/184.47 |
| 6,513,464 | B1 * | 2/2003 | Busch | F01L 3/205 123/65 VA |
| 6,612,273 | B1 * | 9/2003 | Schumacher | F01L 1/04 123/65 VB |
| 7,802,552 | B1 * | 9/2010 | Riley | F01L 1/28 123/193.5 |
| 7,963,259 | B2 | 6/2011 | Meldolesi et al. | |
| 8,490,591 | B1 * | 7/2013 | Perillo | F01L 1/08 123/79 R |
| 2001/0008127 | A1 * | 7/2001 | Matsuda | F01L 3/205 123/41.31 |
| 2006/0021606 | A1 * | 2/2006 | Bryant | F01L 1/053 123/562 |
| 2007/0204814 | A1 | 9/2007 | Scuderi | |
| 2010/0071640 | A1 * | 3/2010 | Mustafa | F01B 9/06 123/54.2 |

OTHER PUBLICATIONS

International Preliminary Report on Patentability (dated Sep. 15, 2016) for corresponding International App. PCT/EP2014/001426.

* cited by examiner

VALVE ARRANGEMENT

BACKGROUND AND SUMMARY

The present invention relates to a valve arrangement for a cylinder of an internal combustion engine arrangement. The invention is applicable for vehicles, in particularly heavy vehicles, such as e.g. trucks. However, although the invention will mainly be described in relation to a truck, the valve arrangement is of course also applicable for other type of vehicles, such as cars, industrial construction machines, wheel loaders, etc.

For many years, the demand on internal combustion engines have been steadily increasing and engines are continuously developed to meet the various demands from the market. Reduction of exhaust gas, increasing engine efficiency, i.e. reduced fuel consumption, and lower noise level from the engines are some of the criteria that becomes an important aspect when choosing vehicle engine.

In order to meet the described demands, various engine concepts have been developed throughout the years where conventional power cylinders have been combined with e.g., a pre-compression stage and/or an expansion stage. Such a cylinder arrangement is often called a two-stage engine, or a dual-stage engine.

A problem with a two-stage engine is that they are too over-expanded at low loads, which means that there is too much intercooled air, or other type of gas, added to the combustion cylinder, which results in that the over-expansion reaches sub atmospheric pressure. Hereby, the efficiency of the cylinder arrangement reduced since sub atmospheric pressure will create energy losses. Also, it is a problem that a lot of air needs to be pumped at low loads, which thus further tends to increase the energy losses of the cylinder arrangement.

EP 1 522 690 relates to a method of operating an internal combustion engine. According to an embodiment, an auxiliary valve is arranged to automatically prevent charge-air back flow from the cylinder.

US 2007/0204814 describes a split-cycle engine with disc valve assembly having a disc valve inlet which is an annular ring disposed between the engine block and the cylinder head.

There is hence a need to be able to control the intake of gas into a cylinder.

It is desirable to provide a valve arrangement which can control the amount of gas being provided into a cylinder of an internal combustion engine arrangement.

According to a first aspect of the present invention there is provided a valve arrangement for a cylinder of an internal combustion engine arrangement, the valve arrangement comprising a check valve configured to be positioned at an intake side port of the cylinder for controlling gas flow into the cylinder, wherein the valve arrangement further comprises an intake valve means positioned upstream from the check valve, and an actuating means configured to controllably position the intake valve means for closing the intake side port.

The wording "check valve" should in the following and throughout the entire description be interpreted as a valve which allows gas or fluid to pass through it in one direction only and thus preventing gas/liquid to flow through it in the other direction. Accordingly, for the above check valve which is configured to be positioned at an intake side port of a cylinder, gas can only flow into the cylinder via the check valve, and not out from the intake side port. A number of different check valves are available, such as a ball check valve, a diaphragm check valve, or a reed valve which will be described further below.

Moreover, the wording "intake valve means" should in the following and throughout the entire description be interpreted as a further valve configured to be positioned at the intake side port of the cylinder. Various types of valves are of course conceivable, and will be described in further detail below.

Furthermore, the "actuating means" should be understood as an arrangement which is configured to position the intake valve means in a closed position. Hence, the actuating means is configured to position the intake valve means in a position such that the intake side port is closed and thus preventing gas from entering the cylinder. Further, and as will be described below, the actuating means may only need to controllably position the intake valve means in a closed position. When the intake valve means is in a position such that the intake side port is closed, the actuating means may no longer need to further provide actuation since the intake valve means will be held in position by the difference in pressure between the cylinder pressure and the ambient pressure, which will be described further below. Accordingly, the actuating means may thus only need to provide a relatively short actuating pulse to arrange the intake valve means in position.

The present invention is based on the insight that by combining a check valve and an intake valve means, a simple valve arrangement is provided which is controlled such that only a desired amount of gas is provided into the cylinder of which the valve arrangement is provided to. Hereby, when the check valve is arranged in an open state, the intake valve means can be controlled for closing the intake side valve at a desired point in time. Accordingly, an advantage of the present invention is that the amount of gas provided into the cylinder, especially at low loads, can be controlled such that too much over-expansion is avoided. Hence, energy losses are reduced and the power efficiency of the cylinder which the valve arrangement is provided to is increased. Hereby, a variable Miller stroke of the cylinder is provided. Furthermore, another problem which is mitigated with the present invention is that excessive expansion is reduced. An excessive expansion cools the exhaust temperature which may create a problem for vehicle after treatment systems.

Moreover, another advantage of using the above check valve is that the need of valve actuating means for starting the vehicle is reduced, since the valve will be arranged in an open/closed position by means of the pressure it is exposed to.

Hence, the check valve provides for a "fail safe mode" when starting the engine at situations where otherwise an actuating means may fail to function. Hence, the check valve increases the reliability for start-up of the engine.

According to an example embodiment, the check valve may be a reed valve.

A reed valve should be understood as a specific type of check valve. The reed valve has at least one plate, or blade, which provides the valve in an open state when the plate/blade is exposed to pressure from a first side and in a closed state when the plate/blade is exposed to pressure from its other side. More specifically, the reed valve is normally, when not exposed to any pressure, in a closed state. When providing the reed valve at an intake side, the plate/blade of the reed valve is arranged to provide the reed valve in an open state when gas is provided into the cylinder and closed when gas is provided out from the cylinder.

An advantage of using a reed valve is that the reed valve can be positioned in an open state by means of a relatively low backpressure from the cylinder. This is advantageous since the backpressure in the cylinder generally generates pumping losses, i.e. energy losses. Accordingly, using a reed valve will thus further increase the energy efficiency of the cylinder arrangement. Furthermore, a reed valve is compact in its configuration which is an important aspect of cylinders since it can further reduce dead volumes in the cylinder. Another advantage is that a reed valve has a relatively low force of inertia which makes the opening/closing of the valve a fast process. Hence, the reed valve can quickly turn from an open state to a closed state, and vice versa.

According to an example embodiment, the valve arrangement may further comprise retracting means configured to position the intake valve means for opening the intake side port when a pressure in the cylinder is above a predetermined pressure threshold limit.

When the intake valve means has been positioned such that it closes the intake side port of the cylinder and the piston in the cylinder moves downward, the pressure in the cylinder will be reduced and the intake valve means will be kept in the closed position by means of the pressure difference between the pressure inside the cylinder and the pressure outside the cylinder. Hereby, the actuating means may be turned off since the difference in pressure will keep the intake valve cans in the closed position. However, when the piston in the cylinder moves upwards again, the pressure will increase and when the pressure is above a predetermined pressure threshold limit, the retracting means will position the intake valve means for opening the intake side port. It should however be readily understood that the increase in pressure will provide the check valve in the closed state, either before the intake valve is positioned in the open state or at the same time as the intake valve means is positioned in the open state. Accordingly, the intake valve means is automatically positioned in the open position when the pressure in the cylinder reaches the predetermined threshold limit.

Furthermore, the timing of when the intake valve means is positioned in the open state can be controlled by means of controlling the retracting means. If the retracting means is a spring, as will be described below, the timing can be controlled by means of the spring stiffness. Hence, the intake valve means can be arranged to be positioned in the open state before the pressure in the cylinder reaches the atmospheric pressure.

According to an example embodiment, the intake valve means may be a slide valve, wherein the actuating means is configured to slidingly position the slide valve for closing the intake side port. A slide valve is advantageous since it provides for a compact valve arrangement.

According to an example embodiment, the intake valve means may be a valve plate, wherein the actuating means is configured to tiltably position the valve plate for closing the intake side port. An advantage of having a tiltable valve plate is that the plate will be provided in the air stream of the cylinder and thus be provided to the closed position by means of the air flow. Hence, the demand on the actuating means is reduced.

According to an example embodiment, the retracting means may be a spring.

A spring is easily provided and may be arranged in many different forms. Also, a spring with suitable spring stiffness can be chosen such that the intake valve means is positioned in the open position when desired.

According to an example embodiment, the retracting means may be a torsion spring.

A torsion spring is particularly useful when having an intake valve means in the form of a valve plate which is configured to tiltably position the valve plate for closing the intake port. Hereby, the torsion spring will be an almost integrated apart in the valve plate, thus reducing of the overall size of the valve arrangement. Further, the torsion spring can also be adapted to tilt the valve plate to desired amounts. For example, the torsion spring can be chosen such that the valve plate is arranged in the open position by rotating the valve plate around the torsion spring by 90 degrees or 180 degrees as seen from the closed state. It can of course be opened to a lesser degree or to a larger degree as well if desired.

According to an example embodiment, the retracting means may be a coil spring. The retracting means may also be a pneumatic spring.

According to an example embodiment, the actuating means may be a pneumatic actuating means. A pneumatic actuating means is advantageous since it can provide a short pulse of pressurized gas that will force the intake valve means to be positioned such that the intake port is closed.

According to an example embodiment, the intake valve means may be a poppet valve actuated by means of the pneumatic actuating means. A poppet valve is advantageous to use when the actuating means is a pneumatic actuating means.

According to an example embodiment, the actuating means may be an electromagnetic actuating means. The electromagnetic actuating means may be a rotating electric motor or a linear electric motor, etc.

Other actuating means than those of the above description are of course also conceivable, such as e.g. a permanent magnet.

According to an example embodiment, the cylinder may comprise a cylinder relief through hole, which in conjunction with a recess arranged in the intake valve means provides fluid communication between an inside volume of the cylinder and a volume delimited by the intake valve means and the check valve when the intake valve means and the check valve are arranged for closing the intake side port.

When the piston of the cylinder is moving in the downward direction within the cylinder and the intake valve means is arranged in a closed state, the cylinder will be exposed to a negative pressure. This negative pressure will have its peak when the piston is in the bottom dead centre of the cylinder. Further, when the piston is at the bottom dead centre the check valve will be arranged in a closed position. Hereby, a relative large negative pressure is provided in the volume that is delimited by the check valve and the intake valve means, which will remain at approximately the same levels during the upward motion of the piston. An advantage with the cylinder relief through hole in conjunction with the recess in the valve means is that gas can be provided from the inside of the cylinder into the volume delimited by the check valve and the intake valve means, such that the negative pressure therein is reduced. The force of the retracting means can thus be reduced which provides for further flexibility in choosing retracting means.

According to an example embodiment, the check valve may comprise a check valve relief through hole for providing fluid communication between an inside volume of the cylinder and a volume delimited by the intake valve means and the check valve when the intake valve means and the check valve are arranged for closing the intake side port.

A further example of relief through hole is provided which allows gas from the cylinder to enter the volume delimited by the intake valve means and the check valve when the intake valve means and the check valve are arranged for closing the intake side port at all times when the check valve is in a closed state.

According to second aspect of the present invention there is provided a cylinder for an internal combustion engine arrangement, the cylinder comprising a check valve arranged at an intake side port of the cylinder for controlling gas flow into the cylinder, wherein the cylinder further comprises an intake valve means positioned upstream from the check valve, and an actuating means configured to controllably position the intake valve means for closing the intake side port.

According to an example embodiment, the cylinder may further comprise a second check valve arranged at an outlet side port of the cylinder for controlling gas flow out from the cylinder.

Hereby, a check valve is used as an intake valve as well as an outlet valve for the cylinder. The advantages of having a check valve at the outlet of the cylinder are analogous to those described above for the check valve at the inlet port.

According to an example embodiment, the cylinder may be a compression cylinder provided in a split-cycle internal combustion engine.

Further effects and features of the second aspect of the present invention are largely analogous to those described above in relation to the first aspect of the present invention.

According to a third aspect of the present invention there is provided an internal combustion engine arrangement comprising a cylinder according to any one of the above described example embodiments.

According to a fourth aspect of the present invention there is provided a vehicle comprising a cylinder according to any one of the above described example embodiments.

Effects and features of the third and fourth aspects of the present invention are largely analogous to those described above in relation to the first and second aspects of the present invention.

BRIEF DESCRIPTION OF THE DRAWINGS

The above, as well as additional features and advantages of the present invention, will be better understood through the following illustrative and non-limiting detailed description of exemplary embodiments of the present invention, wherein.

DETAILED DESCRIPTION

Figure 1:
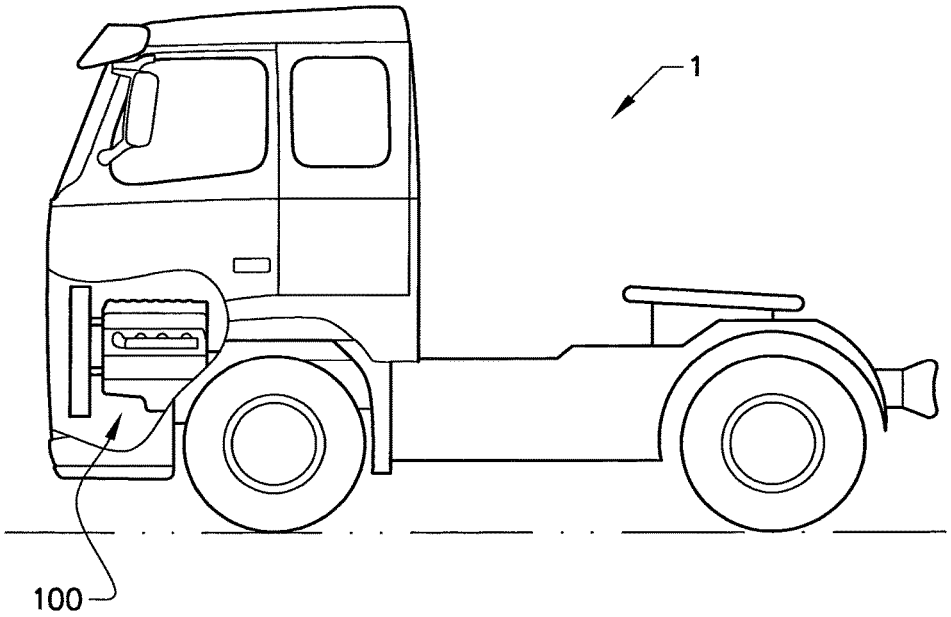
FIG. 1 is a side view of a vehicle comprising an internal combustion engine provided with a valve arrangement according to an example embodiment of the present invention.

The present invention will now be described more fully hereinafter with reference to the accompanying drawings, in which exemplary embodiments of the invention are shown. The invention may, however, be embodied in many different forms and should not be construed as limited to the embodiments set forth herein; rather, the embodiments are provided for thoroughness and completeness. Like reference characters refer to like elements throughout the description.

With particular reference to FIG. 1, there is provided a vehicle 1 with an internal combustion engine arrangement 100 provided with a valve arrangement 101, 201, 301 (see FIGS. 3-8) according to the present invention. The vehicle 1 depicted in FIG. 1 is a truck for which the inventive intern& combustion engine arrangement 100 and the valve arrangement 101, 201, 301, which will be described in detail below, is particularly suitable for.

Figure 2:
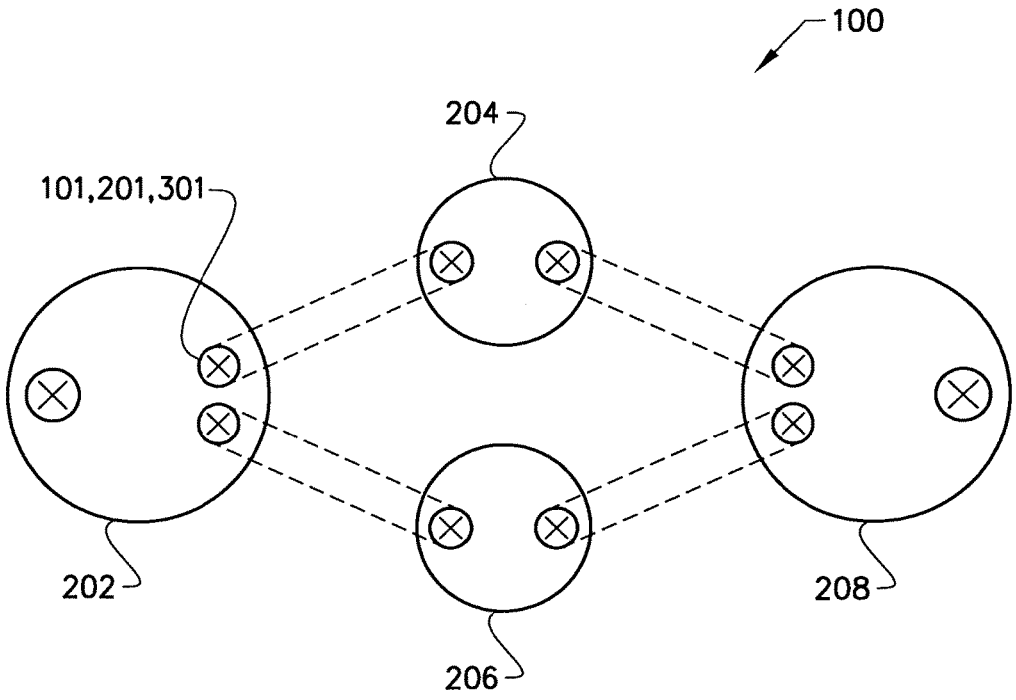
FIG. 2 is a schematic top view of an internal combustion engine arrangement having at least one cylinder provided with a valve arrangement according to an example embodiment of the present invention.

Turning to FIG. 2, illustrating an internal combustion engine arrangement 100 provided with a valve arrangement 101, 201, 301 according to example embodiments of the present invention. The internal combustion engine arrangement 100 depicted in FIG. 2 is a split-cycle internal combustion engine comprising a compression cylinder 202, two combustion cylinders 204, 206, and an expansion cylinder 208. Other configurations of a split-cycle internal combustion engine are of course conceivable, such as e.g. a split-cycle internal combustion engine using two parallel compression cylinders which are each in fluid communication with a respective combustion cylinder. Also, two expansion, cylinders which are arranged in fluid communication with a respective combustion cylinder, is also conceivable. Accordingly, the following description with one compression cylinder, two combustion cylinders, and one expansion cylinder is to be understood as an exemplary embodiment only. According to a further split-cycle concept which the invention is suitable for is an arrangement utilizing two-stage compression, which means that a first compression stage is provided where gas is compressed in a compression cylinder, where compressed gas is delivered to a second compression cylinder where the gas is compressed before being delivered to a combustion cylinder.

Still further, the invention is also applicable for compression cylinders where a cylinder is acting both as a compression cylinder as well as an expansion cylinder. Such a cylinder may provide an expansion stage delimited by the upper end of the piston and the inside of the cylinder and a compression stage delimited by the lower end of the piston and the inside of the cylinder.

In particular, the following description will he directed solely to the compression cylinder 202 and its associated valve arrangement 101, 201, 301.

Figure 3:
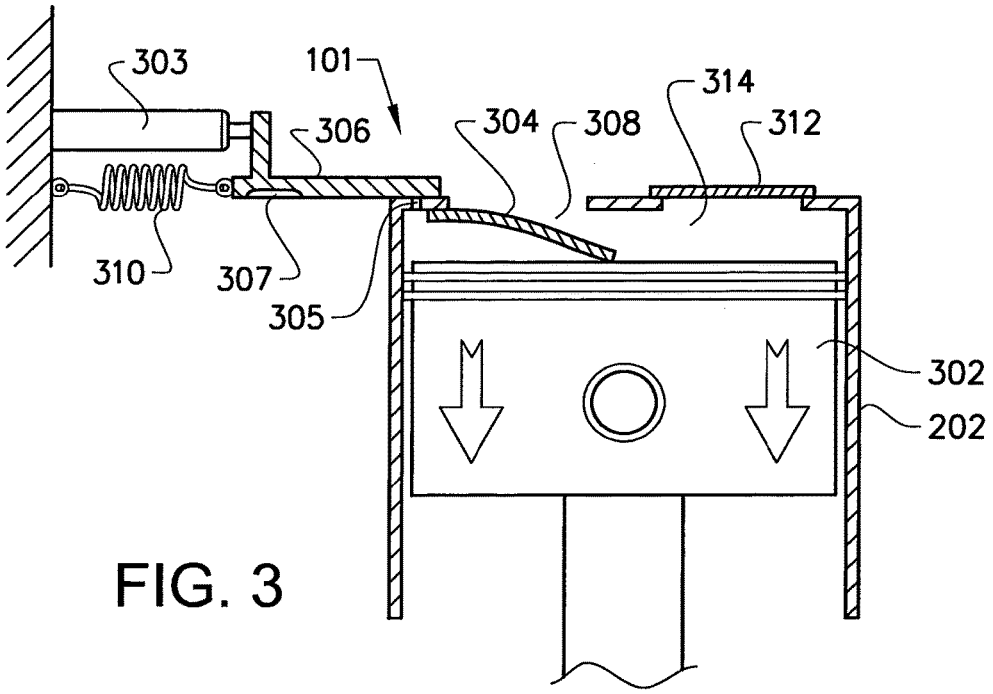
FIGS. 3-6 schematically illustrate the functionality of an example embodiment of the valve arrangement according to the present invention.

Firstly, in order to describe the invention in further detail a short description, with reference to FIG. 2 in conjunction with FIG. 3, is made to a compression cylinder in the sense of the present invention.

A compression cylinder 202 should in the following and throughout the entire description be interpreted as a cylinder housing a compression piston 302, where the cylinder is arranged to provide compressed intake gas to e.g. a combustion cylinder 204, 206. Accordingly, the compression piston 302 compresses gas inside the compression cylinder, which compressed gas thereafter is transferred to the intake of the combustion cylinders. The pressure level of the compressed gas is then above atmospheric pressure. The compression cylinder can work in a two-stroke fashion, which means that when the compression piston is in an upper end position of die cylinder, also known as a top dead centre of the cylinder, gas is provided into the cylinder during the downward motion of the compression piston until the compression piston has reached a desired position, which will be described further below. When the compression piston thereafter has reached the bottom dead centre of the compression cylinder and is in an upward motion towards the upper end position of the cylinder, the gas provided into the cylinder is compressed due to the volume reduction within the cylinder caused by the reciprocating motion of the compression piston. At a desired point in time, the compressed gas is directed out from the compression cylinder and to the intake of the combustion cylinder. The gas which is compressed by the compression cylinder may, for example, be ambient air.

Turning now to FIG, 3, an example embodiment of the valve arrangement 101 and its associated components will be described. The valve arrangement 101 comprises a check valve 304, in FIG. 3 depicted as a reed valve, and an intake valve means 306, depicted as a slide valve. The valve arrangement 101, i.e. the check valve 304 and the intake valve means 306, is positioned at an intake side port 308 of the compression cylinder 202. Hereby, gas is allowed to enter the compression cylinder 202 via the intake side port 308 when the valve arrangement 101 is arranged in the open position as illustrated in FIG. 3. Further, the valve arrangement 101 comprises an actuating means 303. The actuating means 303 is arranged to controllably position the intake valve means 306 in a closed position, such that the intake side port 308 is closed. Controllably positioning the intake valve means 306 for closing the intake side port 308 of the cylinder can be achieved by a short pulse or the like, either hydraulically, pneumatically, or by means of an electric motor, etc. The actuating means illustrated in FIG. 3 is an actuator in the form of a reciprocating cylinder. Furthermore, the valve arrangement 101 also comprises a retracting means 310, here in the form of a coil spring, which is arranged in an un-tensioned state when the intake valve means 306 is arranged in an open position. The retracting means 310 is configured to position the intake valve means in the open position when the spring force exceeds a clamping force exerted on the intake valve means from the pressure of the compression cylinder 202.

Moreover, the compression cylinder 202 depicted in FIG. 3 further comprises a second check valve 312 arranged at an outlet side port 314 of the cylinder. The second check valve 312, here in the form of a reed valve, is configured to be positioned in an open state when compressed gas is to be forced out from the compression cylinder 202 and into e.g. the combustion cylinders 204, 206 depicted in FIG. 2.

Now, reference is made to FIGS. 3-6 in order to describe the functionality of the valve arrangement 101 in combination with the compression cylinder 202. The description is made for a compression cylinder 202 working in a two-stroke compression cycle. However, the invention is equally applicable for a cylinder working in a four stroke compression cycle as well.

At a first stage of the compression cycle, illustrated in FIG. 3, the compression piston 302 is positioned at an upper end position within the compression cylinder 202. The compression piston 302 is in a downward motion towards a lower end position of the compression cylinder, i.e. the bottom dead centre of the compression cylinder 202. The intake valve means 306 is arranged in an open position by means of the retracting force from the retracting means 310. Also, the check valve 304 is in the open position due to suction forces arising from the pressure difference between the pressure inside the compression cylinder and the pressure outside from the compression cylinder during the downward motion of the compression piston.

Hereby, at the first stage of the compression cycle, gas is allowed to enter the compression cylinder since both the intake valve means 306 as well as the check valve 304 are arranged in the open position. Further, the second check valve 312 is arranged in a closed position.

Figure 4:
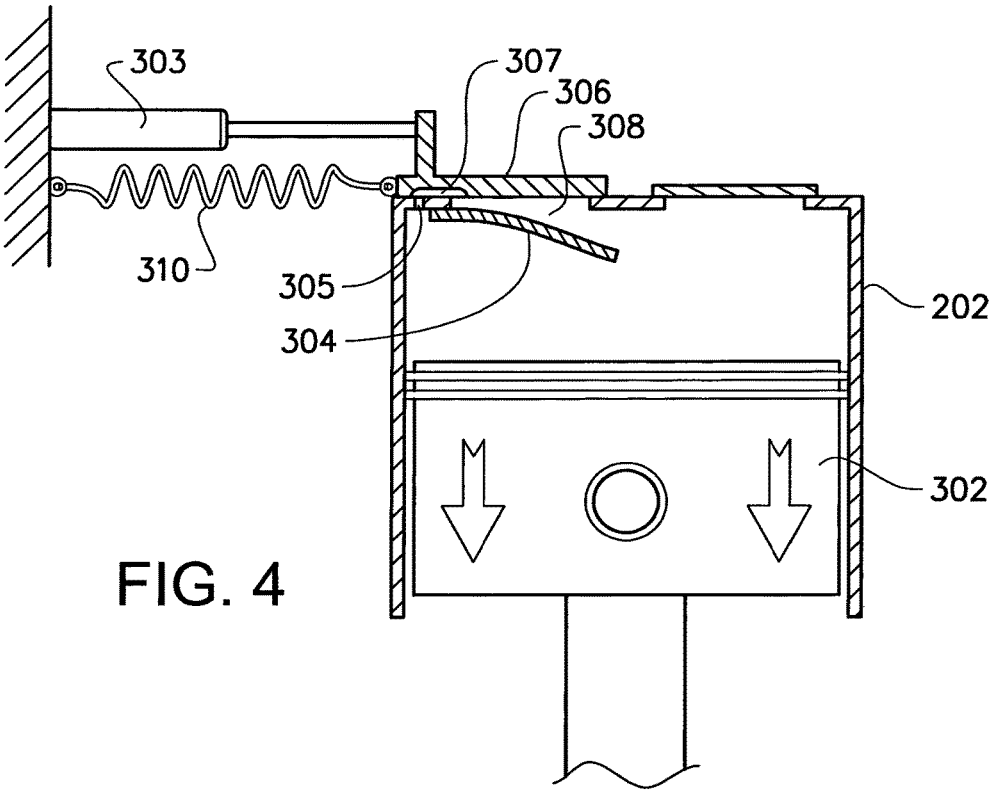

At a second stage of the compression cycle, illustrated in FIG. 4, the compression piston 302 is still in a downward motion towards the bottom dead centre of the compression cylinder 302. The intake valve means 306 is now positioned in a closed state, thus preventing gas from entering the compression cylinder via the intake side port 308. The closing of the intake valve means 306 is executed by a short pulse from the actuating means 303. The actuating force from the short pulse is exceeding the spring force from the retracting means 310 such that the intake valve means 306 is closing the intake side port 308. Now, when the compression cylinder 302 continues its downward motion towards the bottom dead centre of the compression cylinder 202, the pressure within the compression cylinder 202 will be lower compared to the pressure outside the cylinder. This will generate a clamping force on the intake valve means 306, which clamping force will maintain the intake valve means 306 in its closed position. Accordingly, the actuating force in the form of a short pulse is thus no longer needed. Hence, the intake valve means 306 is in this stage not exposed to an actuating force from the actuating means 303. In the second stage of the compression cycle, the compression cylinder will not receive any further gas during the remaining downward motion of the compression piston 302 within the compression cylinder 202. Hereby, the compression cylinder has controllably received a desired amount of gas. Furthermore, a cylinder relief through hole 305 is arranged in the upper portion of the cylinder 202. When the intake valve means 306 is arranged in a closed position, the cylinder relief through hole 305 is aligned with a recess 307 arranged in the intake valve means 306. Hereby, gas can be provided through the cylinder relief through hole 305 and into the intake side port 308 via the recess 307 in the intake valve means 306.

Figure 5:
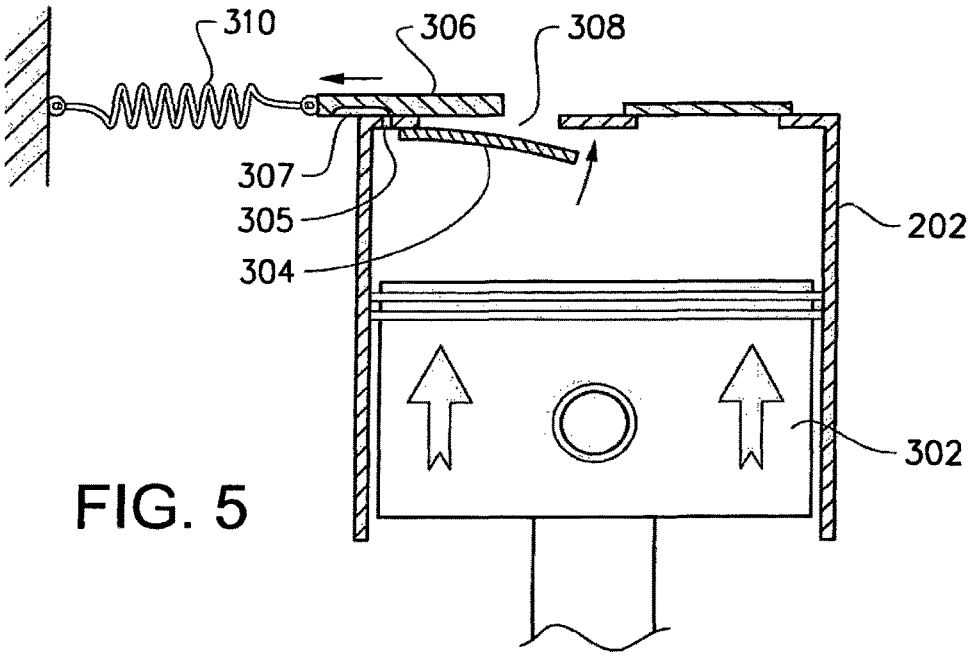

At a third stage of the compression cycle, illustrated in FIG. 5, the compression piston 302 is in an upward motion toward the upper end position of the compression cylinder 202. In FIG. 5. the compression piston 302 is positioned approximately at the same position as depicted in FIG. 4 where the intake valve means 306 was controllably arranged in the closed position. When the compression piston 302 is positioned as depicted in FIG. 5, the pressure within the compression cylinder 202 will be approximately the same as the pressure outside the compression cylinder 202. Hereby, the retracting force from the retracting means will, shortly before the piston reaches the position in FIG. 5, or when it has reached the position in FIG. 5, exceed the above described clamping force and the intake valve means will, by means of the retracting force, be provided at its open position. At approximately the same time as the intake valve means 306 will be arranged in its open position, the check valve 304 will be positioned in its closed position, i.e. the check valve will be arranged in such a way that the intake side port is closed and thus not allowing gas to enter the compression cylinder 302. Although FIG. 5 depicts a small opening of the intake side port, it should be readily understood that when the intake valve means 306 is forced to its open stage, the check valve 304 will be in its closed state such that gas is prevented from being directed out from the compression cylinder via the intake side port 308.

Figure 6:
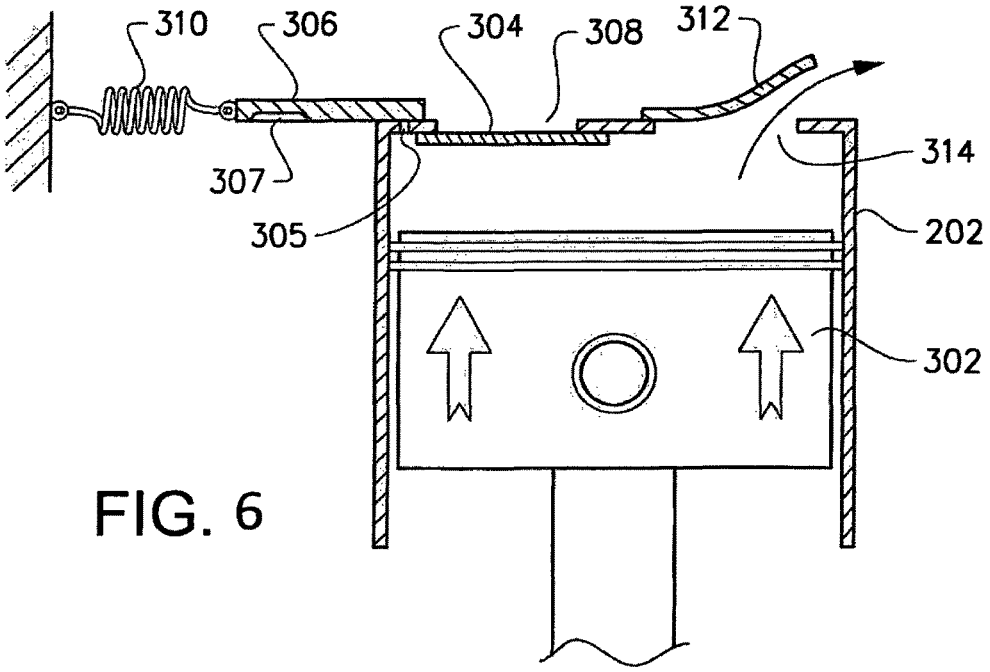

At a fourth stage of the compression cycle, illustrated in FIG. 6, the compression piston 302 is still in an upward motion towards the upper end position of the compression cylinder 202. The intake valve means 306 is arranged in the open position and kept in this position by means of the retracting means 310, while the check valve 304 is arranged in its closed state. Hereby, and as described above in relation to the third stage of the compression cycle, gas is prevented from being directed out from the compression cylinder 202 via the intake side port 308. On the other hand, when the pressure in the compression cylinder has been sufficiently built up, the second check valve 312 will, at this fourth stage, be arranged in an open position such that compressed gas can be forced out from the compression cylinder 202 via the outlet side port 314 and into e.g. the combustion cylinders 204, 206 as depicted and described in relation to FIG. 2.

With the above described cylinder arrangement, the flow of gas into the compression cylinder is controlled such that only a desired amount of gas is provided therein. Hence, the compression cylinder 202 will not receive gas during the complete downward motion of the compression piston 202 within the compression cylinder 302, but instead only receive gas during a specific and desired amount of time of the downward motion of the compression piston 302.

Figure 7:
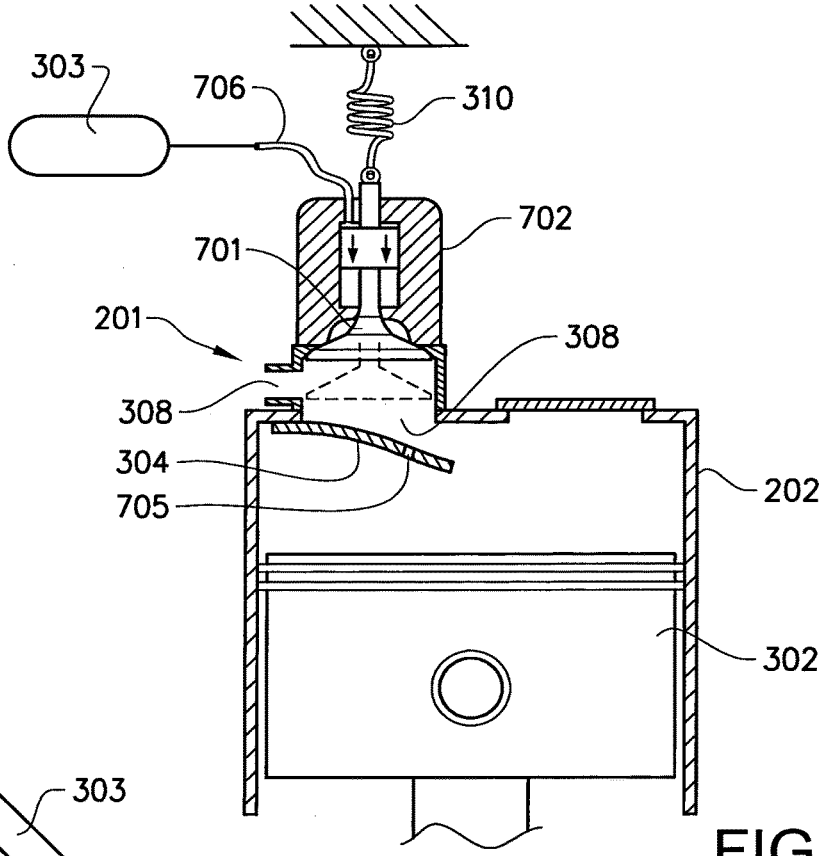
FIG. 7 illustrates a further example embodiment of an intake valve arrangement according to the present invention.
Figure 8:
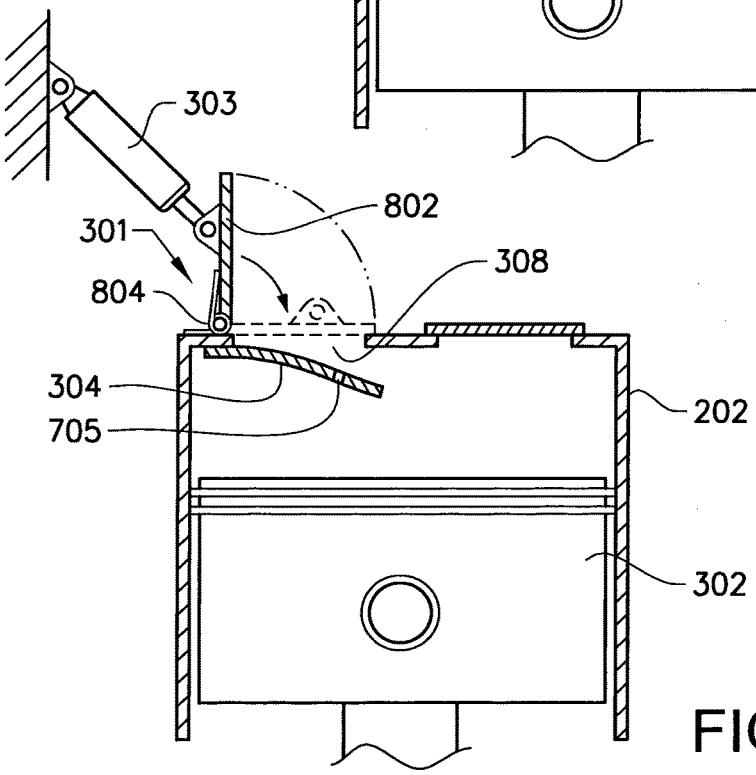
FIG. 8 illustrates a still further example embodiment of an intake valve arrangement according to the present invention.

Reference is now made to FIGS. 7 and 8, illustrating two further example embodiments of the valve arrangement according to the present invention. The functionality of opening and closing the various valves are similar to the above description of the four stages in FIGS. 3-6 unless indicated otherwise.

Turning first to FIG. 7, illustrating a valve arrangement 201 having an intake valve means in the form of a poppet valve 702, and a check valve in the form of a reed valve. The check valve 304 of the embodiment depicted in FIG. 7 has the same functionality as described above and will not be described further. The poppet valve 702 on the other hand is connected to the retracting means 310 on the upper end thereof, which end is facing away from the intake side port 308 of the compression cylinder 202. The retracting means 310 is in the form of a coil spring and has similar functionality as the coil spring described above. Further, the poppet valve 702 is configured to be controllably positioned in a closed state where it prevents gas from entering the compression cylinder via the intake side port 308. More specifically, a piston 701 of the poppet valve is configured to close the intake side port 308 of the compression cylinder 202. The poppet valve 702 in its closed state, i.e. where it is closing the intake side port of the compression cylinder 202, is depicted in FIG. 7 with the piston 701 in dashed lines. Also, the retracting means 310 is configured to retract the piston 701 of the poppet valve 702 to an open state, which open state is illustrated with the piston 701 in solid lines. Furthermore, the poppet valve 702 in FIG. 7 is connected to an actuating means 303 in the form of a pneumatic actuating means 303 positioned at a rear end of the poppet valve in relation to the intake side port 308 and connected to the poppet valve by means of a hose 706 or the like. Hence, the piston 701 of the poppet valve is arranged between the pneumatic actuating means and the intake side port 308 of the compression cylinder 202. The pneumatic actuating means 303 is configured to provide the above described actuating force by means of providing a short pulse of pressurised air, which will force the piston 701 of the poppet valve 702 to be arranged in the closed position until the pressure difference between the pressure inside the compression cylinder 202 and the pressure outside the compression cylinder 202 is such that it will keep the piston 701 in the closed position, as described above.

Finally, reference is made to FIG. 8, illustrating a still further example embodiment of the valve arrangement 301 according to the present invention. The difference between the valve arrangement 301 depicted in FIG. 8 and the valve arrangements depicted in FIGS. 3 and 7 is mainly relating to the intake valve means 802 and its associated retracting means 804.

The valve arrangement 301 depicted in FIG. 8 comprises an intake valve means 802, in the form of a valve plate, and a check valve in the form of a reed valve as described above. The intake valve means 802 is connected to a retracting means 804 in the form of a torsion spring. The intake valve means 802 is also, as for the embodiment depicted and described in relation to FIG. 3, connected to an actuating means 303 for controllably position the intake valve means for closing the intake side port 308. Hereby, the valve plate 802 is configured to be tiltably arranged in the open and closed position, respectively. The valve plate depicted and described in relation to FIG. 8 is tilting between the closed position (seen in dashed lines) and the open position (seen in solid lines) by an approximately 90 degrees tilting. The valve plate may of course be tilting between an open state and a closed state by e.g. 180 degrees instead of 90 degrees.

As illustrated in both FIG. 7 and FIG. 8, the check valve 304 comprises a check valve relief through hole 705 which allows gas to be guided from the inside of the cylinder 202 and into the volume which is delimited by the intake valve means and the check valve when these valves are arranged in a closed state.

It is to be understood that the present invention is not limited to the embodiments described above and illustrated in the drawings; rather, the skilled person will recognize that many changes and modifications may be made within the scope of the appended claims. For example, the intake valve means may also be a slide plate which is connected to a retracting means in the form of a torsion spring such that the slide plate slides between an open position and a closed position by means of rotating the slide plate relative to the compression cylinder.

The invention claimed is:

1. A valve arrangement for a cylinder of an internal combustion engine arrangement, the valve arrangement comprising a check valve configured to be positioned at an intake side port of the cylinder for controlling gas, flow into the cylinder, an intake valve means positioned upstream from the check valve, and a pulse controlled actuating means configured to controllably position the intake valve means for closing the intake side port, wherein, when in a closed position, the intake valve means contacts an outer surface of the cylinder around the intake port and seals against the outer surface of the cylinder around the intake side port when pressure inside of the cylinder is lower than pressure outside of the cylinder.

2. The valve arrangement according to claim 1, wherein the check valve is a reed valve.

3. The valve arrangement according to claim 1, further comprising retracting means configured to position the intake valve means for opening the intake side port when a pressure in the cylinder is above a predetermined pressure threshold limit.

4. The valve arrangement according to claim 3, wherein the retracting means is a spring.

5. The valve arrangement according to claim 3, wherein the retracting means is a torsion spring.

6. The valve arrangement according to claim 3, wherein the retracting means is a coil spring.

7. The valve arrangement according to claim 1, wherein the intake valve means is a slide valve, wherein the actuating means is configured to slidingly position the slide valve for closing the intake side port.

8. The valve arrangement according to claim 1, wherein the intake valve means is a valve plate, wherein the actuating means is configured to tiltably position the valve plate for closing the intake side port.

9. The valve arrangement according to claim 1, wherein the actuating means is a pneumatic actuating means.

10. The valve arrangement according to claim 9, wherein the intake valve means is a poppet valve actuated by the pneumatic actuating means.

11. The valve arrangement according to claim 1, wherein the actuating means is an electromagnetic actuating means.

12. A cylinder for an internal combustion engine arrangement, the cylinder comprising a valve arrangement according to claim 1.

13. The cylinder according to claim 12, further comprises a second check valve arranged at an outlet side port of the cylinder for controlling gas flow out from the cylinder.

14. The cylinder according to claim 12, wherein the cylinder is a compression cylinder provided in a split-cycle internal combustion engine.

15. An internal combustion engine arrangement comprising a cylinder according to claim 12.

16. A vehicle comprising a cylinder arrangement comprising a cylinder according to claim 12.

17. A valve arrangement for a cylinder of an internal combustion engine arrangement, the valve arrangement comprising a check valve configured to be positioned at an intake side port of the cylinder for controlling gas flow into the cylinder, an intake valve means positioned upstream from the check valve, and a pulse controlled actuating means configured to controllably position the intake valve means for closing the intake side port, wherein the cylinder comprises a cylinder relief through hole, which in conjunction with a recess arranged in the intake valve means provides fluid communication between an inside volume of the cylinder and a volume delimited by the intake valve means and the check valve when the intake valve means and the check valve are arranged for closing the intake side port.

18. A valve arrangement for a cylinder of an internal combustion engine arrangement, the valve arrangement comprising a check valve configured to be positioned at an intake side port of the cylinder for controlling gas flow into the cylinder, an intake valve means positioned upstream from the check valve, and a pulse controlled actuating means configured to controllably position the intake valve means for closing the intake side port, wherein the check valve comprises a check valve relief through hole for providing fluid communication between an inside volume of the cylinder and a volume delimited by the intake valve means and the check valve when the intake valve means and the check valve are arranged for closing the intake side port.

19. A method for a cylinder of an internal combustion engine arrangement comprising a check valve configured to be positioned at an intake side port of the cylinder for controlling gas flow into the cylinder, and an intake valve means positioned upstream from the check valve, the method comprising:

controlling a pulse controlled actuating means to controllably position the intake valve means for closing the intake side port;

allowing, when the intake valve means has been positioned such that it closes the intake side port and a piston in the cylinder moves downward, pressure in the cylinder to be reduced and the intake valve means to be kept in the closed position by a pressure difference between pressure inside the cylinder and pressure outside the cylinder; and allowing retracting means to position the intake valve means for opening the intake side port when pressure in the cylinder is above a predetermined pressure threshold limit.

* * * * *